United States Patent [19]

Graham

[11] 4,254,716

[45] Mar. 10, 1981

[54] METHOD AND APPARATUS FOR PREPARING ORGANIC WASTE FUELS

[76] Inventor: Donald H. Graham, 4411 NW. 15th Pl., Gainesville, Fla. 32605

[21] Appl. No.: 949,208

[22] Filed: Oct. 6, 1978

Related U.S. Application Data

[63] Continuation-in-part of Ser. No. 742,379, Nov. 16, 1976, abandoned.

[51] Int. Cl.[3] ..... F23G 5/04

[52] U.S. Cl. ..... 110/346; 110/187; 110/222; 110/224

[58] Field of Search ..... 110/346, 187, 219–224

[56] References Cited

U.S. PATENT DOCUMENTS

| | | | |
|---|---|---|---|
| 3,734,036 | 5/1973 | Abos | 110/346 |
| 3,954,069 | 5/1976 | Loren | 110/346 X |
| 4,015,546 | 4/1977 | Paules | 110/187 |
| 4,133,273 | 1/1979 | Glennon | 110/346 |

*Primary Examiner*—Edward G. Favors

*Attorney, Agent, or Firm*—Duckworth, Hobby, Allen & Pettis

[57] ABSTRACT

An integrated fuel preparation and incinerator system and method for utilizing organic solid and semi-solid waste materials as a primary boiler fuel is provided. The organic waste fuel materials are refined to allow for improved combustion efficiency. Combinations of the organic fuel wastes with inorganic wastes are first dried to attain maximum thermal potential; and thereafter, special dry precombustion processing allows for the removal of undesirable inorganics, thereby reducing the adverse physical and chemical effects upon the process hardware.

The organic waste fuels are further refined during drying to a constant moisture which enhances combustion flame stability and organic fuel burnout efficiency. Drying with waste heat prior to classification also allows for overall system energy conservation, permits the relatively simple mechanical removal of entrained inorganics, and reduces energy requirements for final sizing and dispersion processing prior to the improved full suspension combustion firing phase. Using the waste heat from the combustion flue gasses as a drying media also enhances the quality of the air effluents.

17 Claims, 1 Drawing Figure

METHOD AND APPARATUS FOR PREPARING ORGANIC WASTE FUELS

This application is a continuation-in-part of application Ser. No. 742,379, filed Nov. 16, 1976 now abandoned.

BACKGROUND OF THE INVENTION

This invention relates to a system and method for utilizing prepared solid and semi-solid organic waste materials as a primary fuel in a full suspension or semi-suspension fired conventional combustion boiler in a manner that improves the system's efficiency through improved combustion and an overall energy effectiveness. The process also reduces the quantity of adverse environmental residual effluents.

Disposal of organic waste materials continues to be an increasingly critical problem. Efforts are being made to develop equipment and processes for disposal of the wastes through improved energy recovery techniques.

Prepared solid waste (refuse derived fuel) incineration technology is well known for use as a supplemental fuel in the utility industry for co-combustion with coal, however attempts to utilize the mixed material as a base primary fuel are limited and far from being optimum.

Organic waste fuels almost always contain non-combustible solid inorganic materials, e.g., glass and sand, which cannot be incinerated and therefore detract from the thermal equivalence of the base fuel and in addition have a detrimental impact upon the process equipment. The inert non-combustible solids cause boiler tube erosion and slagging in addition to increasing the particulate loadings to the effluent gas scrubbers.

SUMMARY OF THE INVENTION

In accordance with this invention, a refined fuel preparation and combustion system for the thermal oxidation of mixed organic waste materials containing an admixture of combustible and non-combustible solid waste is provided which substantially eliminates certain of the problems associated with prior waste incineration systems.

Advantages of the process of the present invention over the existing technology include among others, increased combustion efficiency, small boiler volume requirements, reduced system erosion and corrosion, reduced effluent gas volumes requiring treatment, and potentially lower initial system capital investment.

The prepared organic waste energy conversion system of the present invention comprises in combination: (a) a surge storage silo where a combination of sized inorganic and organic wastes can be delivered either mechanically or pneumatically and admixed; (b) a surge silo with multiple discharge device capable of removing, mechanically metering, and discharging the fuel into either pneumatic or mechanical transport conveyors; (c) a dryer, either of a single or multiple pass, or fluid bed design capable of employing the particulate laden hot flue gasses from an energy recovery boiler as the drying media. The dryer is temperature controlled by allowing ambient tempering air to bleed into the system. The dryer, in addition to acting as a ballistic classifier and scavenger for flue gas particulate, pneumatically discharges an admixture of both inorganic and organic fuel at a uniform moisture content into a discharge cyclone; (d) the cyclone, through an air lock, feeds a ballistic screen or air classifier that removes inorganic contaminants from the organic rich fuel fraction mixture; (e) the cooled, reduced volume particulate, laden with boiler flue gas, is passed to a final scrubber, such as a high energy dry gas scrubber or a dynamic packed column type; (f) the reclassified organic fuel components are then mechanically or pneumatically transported and equally distributed into metering surge bins that are integrated with the boiler's thermal demand control network devices; (g) these surge bins then meter and feed the mixed organic fuel mixture into attrition type final fuel preparation and dispersion size reducing grinders; (h) the grinders maximize the particle surface area at a reduced minimum energy requirement, due to the reduced inorganic contaminate concentration and the pre-drying which embrittles any organic fiberous organic materials and prior classification to remove dried inorganics; (i) the dispersed fiberized fuel particles are pneumatically injected into a conventional full suspension or semi-suspension fired heat recovery boiler capable or producing a high turbine quality superheated steam up to 750° F.; (j) the boiler system is equipped with flue gas multi-cyclone scrubbers for large particle removal, which is combined with the furnace's bottom ash in a dry recovery pneumatic ash handling process that eliminates the need for any bottom ash wastewater treatment processes; (k) the system is totally enclosed, and all effluent streams are vented through scrubbers or filters to remove any noxious environmental contaminants that could be detrimental to health; (l) the system may be equipped with transducers and safety devices to guard and protect against fires or explosions.

THE DRAWING

The organic waste energy conversion system of this invention is more fully illustrated by the reference drawing and following description.

FIG. 1 is a flow chart illustrating the apparatus and the method of the present invention.

DETAILED DESCRIPTION OF THE PREFERRED EMBODIMENT

Figure 1:
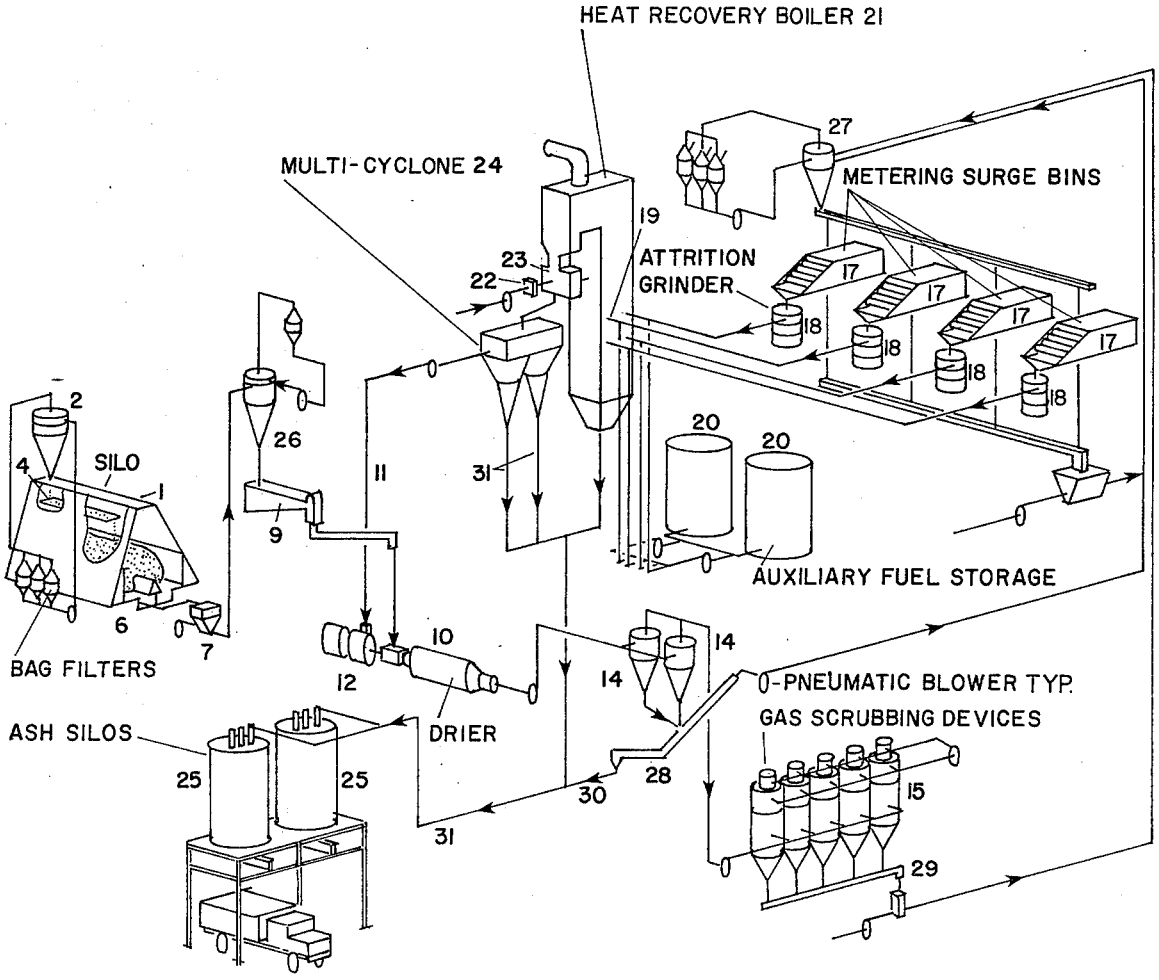

In FIG. 1, an admixture of inorganic and organic wastes is received in a storage silo 1. the silo is one of several commercial types being marketed today for handling waste solids. Ideally, the silo should be designed so that the first waste fuel material in, is the first out. Silos of this type are produced by the Miller Hofft Corporation in Richmond, Va., and are used in the wood bark industry. The silo is equipped with a cyclone 2, and with bag house filters for air effluents, which accomodate pneumatic deliveries, either from a vehicle or an adjacent processing facility. Cyclone 2 is representative of all the cyclones shown in the drawing. Cyclone separators are the most widely used type of dust collection equipment. The dust-laden gasses enter a cylindrical or conical chamber tangentially at one or more points and leave through a central opening. The dust particles by virtue of their inertia, tend to move toward the outside of the separator wall, from which they are led into a receiver. The cyclone 2 is a settling chamber in which the gravitational acceleration is replaced by centrifugal acceleration. At operating conditions commonly employed, the centrifugal separating force or acceleration may range from five times gravity in very large diameter low resistance cyclones to 2500 times gravity in very small high resistance units. Conventional cyclone collectors of this type offer one of the least expensive means of dust collection, from both an operating and an investment viewpoint. Cyclones have been employed to remove solids and liquids from gasses and solids from liquids and have been operated at temperatures as high as 1000° C. and pressures as high as 500 atmospheres. Cyclones for removing solids from gasses are generally applicable where particles of over 5 microns or 0.0002 inches in diameter are involved, although some of the multiple tube parallel units attain 80 to 85 percent efficiency on particles of 3 microns in diameter. The bag filters 50 in this process are utilized as air scrubbers to remove the fine micron and submicron particulate that is not removed by the cyclone 2, so as to meet state and federal air pollution codes.

Mechanical deliveries 4 are discharged onto a transversing distributing feed conveyor commonly found in silo designs. The admixture is uniformly discharged by bottom bin unloaders 6 into mechanical or high pressure pneumatic transport systems via an air lock feeder 7. Air lock 7 is conventional; one commercially available air lock feeder is manufactured by Rader Pneumatics of Memphis, Tenn.

The material is conveyed via cyclone 26 to a second air lock surge feeder and a feed screw 9, into a fuel dryer 10. The fuel dryer can be of several commercial types, including single or multiple pass rotary units, or the more sophisticated fluid bed type. A dryer suitable for use as the dryer 10 is made by the Heil Corporation of Milwaukee, Wis. The drying media from the boiler is a media showing exiting the the cyclonic separators through process line 11. Tempering air is also admitted into the dryer 10 in a controlled manner; as is required to control the temperture of the heat applied to the material output from the screw 9. In the Heil rotary dryer, the drying gasses serve as the transport media for moving the solids through the dryer 10. The drying media is the energy laden flue gasses 11 from the waste heater boiler 26. These hot combustion flue gasses are automatically tempered with ambient air 12 to accomodate the variations in the organic fuel moisture levels. The variation is typically between 10 and 60 percent water, dependent upon geographical or seasonal variations.

Materials pneumatically transported through the dryer 10 tend to be classified according to size and moisture, allowing the lighter, dryer particles to pass through more quickly. The contact between the hot particulate laden flue gasses and the dry organic fuel readily agglomerates much of the fine particulates from the flue gas onto the organic fuel particles, thus reducing the particulate loading on the effluent gas scrubbing devices 15. Particulate removed from these devices is recycled to the fuel stream 29. Particulates of the type which will agglomerate here are basically celluloid organic in nature. Other materials which may be included are those of a film, plastic or metallic film. Primarily, particulates which will agglomerate here are those that will retain a static charge and tend to collectively agglomerate and build to larger masses which will settle out in the cyclonic settling chambers or be finally entrapped in the baghouses, described below. As will be described in greater detail below, the particulate output from the gas scrubbing devices 15 are pneumatically transported to cyclone 27 which feeds the metering surge bins which, in turn, feed the hoppers 17 which, in turn, go to the boilers as secondary fuel recycle. Conversely, the inorganic materials coming out of cyclone 14 which have very low fuel value are transported directly to the ash silos 25 for ultimate disposal.

As noted above, the dry organic fuel from the dryer 10 is discharged from cyclones 14 onto a ballistic screener and air classifier 28 to allow separation of the inorganic glass/sand particles from the dry, fiberous base organic fuel, due to the reduction in adhesive forces which occurred during drying. The discharge or the gasses out of cyclones 14 become the feed to the gas-scrubbers 15. Scrubbers 15 are conventional equipment, primarily high-energy gas scrubbers. A prime manufacturer of this type of device is Aerodyne, located in Cleveland, Oh. Scrubbers of this nature are commonly applied in the wood-waste burning industry or for meeting air pollution codes. Ballistic screen 28 is of a conventional design. Manufacturers of ballistic screens are the Triple S Dynamics Corporation of Dallas, Tex. The inorganic glass/sand 30 is mechanically removed and injected into the dry ash handling system 31. The ash handling system and storage silos 25 is mechanical or pneumatic. An enclosed dry ash handling process has numerous environmental advantages over the wet ash sludge systems which create sludges that require wastewater treatment and disposal. The dry ash has numerous produce applications, dependent upon the final inorganic material's chemical composition and local construction activities.

The dry, fibrous base organic fuel output from the classifier 28 typically consists of a multitude of waste fractions being derived from municipal waste, wastewater sludges and other commercial waste sources. Refuse-derived fuel constitutes a large percentage of the organic-based waste utilized in conventional processes. This refuse-derived fuel consists largely of paper, plastics, textiles, putrescible organics, and other low-density materials that have been air-classified from coarse shredded municipal refuse. These air-classified "lights" are screened to remove primary grit and dirt and then further shredded to a fine particle size. Typical density (wet) in an uncompacted state is 2 to 5 lbs. per cubic foot. Typical moisture content range is from 10 to 35 percent, with an average of about 20 to 25 percent. Typical free inorganic content is 2 to 7 percent, with an average of 4 to 5 percent by weight. Typical total ash content is from 5 to 25 percent, with an average of 12 to 15 percent by weight. The size distribution of this material is generally 90 percent of the material passing a ¾-inch square mesh screen and 100 percent of the material passing a 1-inch square mesh screen. Based upon previous pilot test programs, an average heating value of the as-received material is between 6000 and 7000 BTU's per pound, with a range of 4500 to 8000 BTU's per pound. The normal physical component distributions are as follows:

| Component | % |
|---|---|
| Aluminum | .3 |
| Glass ceramics | 4.9 |
| Paper | 81.9 |
| Plastics | 6.5 |
| Organics | 6.2 |
| Misc. & unaccountables | .3 |
| | 100.0 |

Classifier 28 is a ballistic type inclined screener that carriers the larger fuel fractions upward as the vibrating action of the screener shakes the inorganics free from the fuel fractions and allows them to sift through the screen deck and filter toward the bottom of the screener for removal through line 30 and 31 to the ash fuel silos, while the fuel-rich organic components are transported to the pneumatic blower for recycle back to the metering surge bins 17 as a supplemental fuel component.

The constant moisture organic fuel material as an output from the scrubbers 15 is transferred and distributed to the multiple metering surge bins 17. This transfer is depicted as being pneumatic through a cyclone 27; however, enclosed mechanical conveyence are also suitable. These metering surge bins 17 typically include automated leveling devices with bottom drag chain discharges for feeding the final fuel to shear grinders 18. Feed to the surge bins is controlled by load level switches on the surge bins which indicate that the boiler feed demands are less than the system's total output of product, thus a feed loop control device back to the silo feeding the fuel preparation system is actuated and the silo discharge is reduced according to the system's total requirements. A certain amount of surge fluctuations is compensated for by item 17, the "metering surge bins". Surge bins 17 are conventional devices made by the American Sheet Metal Company of Atlanta, Ga. These devices are sometimes referred to as "doffin roll bins", and are often used in the wood waste processing industry. The grinders 18 are also conventional, attrition type mills. Beloit Jones of Massachusetts manufactures a suitable grinder.

The grinders 18 maximize the organic fuel particle surface area into a particle size which is easily air suspended and will allow full suspension combustion. The final fuel size may vary, dependent upon fuel characteristics and furnace combustion residence time. The preferred particle size range and the fuel particle desired is about 90 percent less than ¾-inch square mesh or finer. The required particle size is somewhat dependent upon the final system configuration and boiler size and the related residence time within the boiler chamber and whether the boiler is a full-suspension fired or a semi-suspension fired, in other words, whether the boiler has a grate at the bottom that would compensate for larger particles which require a longer residence burning time. The attrition grinding energy requirements are reduced about 30–50 percent due to the reduced controlled moisture level of the organic fuel mixture and the fiber embrittlement resulting from drying.

During the defiberizing attrition grinding in the grinders 18, the organic fuel particulate is dispersed into the air stream that carries the particles in suspension into the individual cyclonic furnace nozzles 19. Maximum surge bin/grinding combustion redundancy is considered desirable to augment the boiler's reliability and process combustion efficiency. The number of furnace combustion nozzles 19 and supporting surge bin 17 and grinders 18 is depicted as four in FIG. 1; however, this number can vary from one to many.

The system has additional fuel redundancy through an auxiliary fuel source 20, e.g., oil. The auxiliary source 20 provides a stabilizing burner flame backup in the event upset system conditions should require such.

This process and associated apparatus for preparing organic waste fuel allows boiler configurations 21 that are significantly smaller in size than the more conventional semi-suspension fired traveling grate stoker units. The refined, prepared organic fuel in suspension with a particulate laden flue gas allows for reduced excess air operations and reduces potential boiler corrosion because of the added removal of trace elements and the minimal occurrence of a reducing atmosphere. This feature allows the production of a transportable superheated steam product with temperature up to 750° F., suitable for electrical generating turbines.

Flue gasses from the boiler 21 are tempered by passing them through combustion air preheaters 23. The degree of tempering is dependent upon incoming organic fuel moisture content. Should the moisture level be high, process steam is utilized in the auxiliary combustion air preheater 22 to assure proper combustion flame stability. The advantage of preheating the air and drying the fuel to a fixed moisture content is to enhance the energy effectiveness of the entire system and the fuel application and reducing the gaseous volume to be treated prior to environmental discharges. The lower the fuel moisture content prior to injection into the combustion boiler 21, the greater its thermal value. The utilization of these flue gasses from the boiler 21 as a low-energy heat source for drying the fuel is not only an economical but overall energy-effective approach to waste thermal combustion.

The organic fuels basically are self-sustaining or autogenic when their moisture content is below 40 percent by weight as received. If this moisture content is reduced as low as possible, but in reality 10 to 15 percent, their thermal value is enhanced proportionately. Handling of materials below the 10 to 15 percent moisture level imposes certain special handling and safety criteria considerations since their explosibility increases as well as their susceptibility to fire and dust explosions.

Flame stability is a measure of the ability of the boiler 21 to sustain combustion with the base fuel without the need for a supplemental stabilizing pilot flame from another outside independent fuel source, such as a fossil of either natural gas or fuel oil. If the fuel moisture level is high, the flame stability is reduced, thus increasing the possible need for an auxiliary stabilizing flame source. It would be desirable to reduce moisture in the incoming fuel, and this is achieved by increasing the waste heat stream to the fuel dryer 10 to lower the resulting fuel product moisture level.

The furnace flue gasses are passed through a multicyclone separator 24 enroute to the fuel dryer 10. This separator 24 removes any large particles through lines 31 and reduces the risk of dryer fires. Cyclone 24 is like the other cyclones, except that its prime purpose in this case is as a dual cyclone, which is intended to remove entrained organic and inorganic particulate from the flue gasses out of the boiler 21 that might have been carried over from the combustion chamber. Many of these particulates are very small in nature, although some agglomeration may occur during the cyclonic separation phase, thus allowing these materials to fall out of the bottoms of these cyclones 24 prior to the effluent hot gasses entering the inlet chamber to the flue dryer 10. These residuals captured by the cyclones 24 on the boilers exit flue gasses then become a part of the ash stream for ultimate alternative disposal.

The depicted process is complemented by the numerous other auxiliary standard components not shown, e.g., boiler feed water treatment system, integrated process controls, etc., not considered unique to this process invention. Various modifications and refinements are contemplated and may be resorted to without departing from the intent, function, or scope of this information.

I claim:

1. A method for preparing, classifying, and using an admixture of organic and inorganic materials as a fuel, said method comprising the steps of:

drying said admixture prior to any classification to a relatively constant, predetermined moisture content level;

classifying said admixture following said drying step to remove most of said inorganic materials therefrom; thereafter grinding the organic constituents of said controlled moisture admixture to a reduced particle size; and thereafter feeding said reduced particle size organic constituents into a furnace.

2. The method recited in claim 1 wherein said furnace is of the type having a flue gas discharge, said drying step comprising the step of passing the output from said flue gas discharge through said admixture.

3. The method recited in claim 2, further comprising the step of controlling the moisture content of said flue gas, in order to obtain said relatively constant moisture content level of said admixture as an output of said drying step.

4. The method recited in claim 3 further comprising the step of metering the flow of said constant moisture organic constituents dependent upon the fuel requirements of said furnace.

5. The method recited in claim 3, further comprising the step of mixing the output of said grinding step with an auxiliary fuel.

6. The method recited in claim 3, further comprising the step of removing particulate matter from said flue gas discharge of said furnace, prior to passing said discharge through said admixture.

7. The method recited in claim 2, wherein the moisture content of said admixture following said drying step is less than 35 percent.

8. The method recited in claim 2, wherein the inorganic material content with said organic material following said classifying step is less than 10 percent.

9. The method recited in claim 2, wherein 100 percent of said reduced size organic constituents from said grinding step passes a 1-inch square mesh screen.

10. A method for preparing, classifying and using an admixture of organic and inorganic materials as a fuel, said method comprising the steps of:

drying said admixture prior to any classification to a relatively constant moisture content level of substantially less than 35 percent moisture in said dried admixture;

classifying said admixture following said drying step to remove most of said inorganic materials therefrom; thereafter grinding the organic constituents of said controlled moisture admixture to a reduced particle size; and thereafter feeding said reduced particle size organic constituents into a furnace.

11. The method recited in claim 10, wherein said furnace is of a type having a flue gas discharge, said drying step comprising the step of passing the output from said flue gas discharge through said admixture.

12. The method recited in claim 10, wherein the organic material content with said organic material following said classifying step is less than 10 percent.

13. The method recited in claim 12, wherein 100 percent of said reduced size organic constituents from said grinding step pass a 1-inch square mesh screen.

14. The method for preparing, classifying and using an admixture or organic and inorganic materials as a fuel, said method comprising the steps of:

drying said admixture prior to any classification to a relatively constant moisture content level of less than 35 percent moisture;

classifying said admixture following said drying step to remove most of said inorganic materials therefrom, such that the inorganic material content with said organic material following said classifying step is less than 10 percent; thereafter grinding the organic constituents of said controlled moisture admixture to a reduced particle size, such that 100 percent of said reduced particle size organic constituents pass a 1-inch square mesh screen; thereafter feeding said reduced particle size organic constituents into a furnace, said furnace being of the type having a flue gas discharge; and thereafter passing the output from said flue gas discharge through said admixture during the continuation of said drying step.

15. The apparatus for preparing, classifying and using an admixture of organic and inorganic materials as a fuel, said apparatus comprising:

means for drying said admixture prior to any classification to a relatively constant, predetermined moisture content level;

means for receiving said dried admixture from said drying means and classifying said admixture to remove most of the inorganic materials therefrom;

means for receiving the organic constituents of said admixture as an output from said classifying means and grinding said organic constituents to a reduced particle size; and means for feeding said reduced particle size organic constituents into a furnace.

16. The apparatus recited in claim 15, wherein said furnace is of the type having a flue gas discharge, said apparatus further comprising means for passing the output from said flue gas discharge into said drying means and through said admixture.

17. Apparatus for preparing, classifying and using an admixture of organic and inorganic materials as a fuel, said apparatus comprising:

means for drying said admixture prior to any classification to a relatively constant moisture content level of substantially less than 35 percent moisture;

means for receiving the dried admixture as an output from said drying means and classifying said admixture to remove most of the inorganic materials therefrom, such that the inorganic material content with said organic constituents of said admixture following classification is less than 10 percent;

means for receiving the classified organic constituents as an output from said classifying means and grinding said organic constituents to a reduced particle size, such that 100 percent of said reduced particle size organic constituents pass a 1-inch square mesh screen;

means for receiving the reduced particle size output from said grinding means and feeding said output into a furnace having a flue gas discharge; and means for receiving said flue gas discharge from said furnace and passing said discharge into said drying means and through said admixture.

* * * * *